US006648739B2

(12) United States Patent
Izumi et al.

(10) Patent No.: US 6,648,739 B2
(45) Date of Patent: Nov. 18, 2003

(54) WAFER POLISHING APPARATUS

(75) Inventors: Hirohiko Izumi, Mitaka (JP); Satomi Michiya, Mitaka (JP); Takashi Fujita, Mitaka (JP); Minoru Numoto, Mitaka (JP); Mikhail Tuzov, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 09/898,090

(22) Filed: Jul. 5, 2001

(65) Prior Publication Data

US 2002/0004361 A1 Jan. 10, 2002

(30) Foreign Application Priority Data

Jul. 5, 2000 (JP) ..... 2000-203520

(51) Int. Cl.[7] ..... B24B 29/00
(52) U.S. Cl. ..... 451/286; 451/287
(58) Field of Search ..... 451/285, 286, 451/287, 288, 41, 54, 55, 59

(56) References Cited

U.S. PATENT DOCUMENTS 5,584,751 A 12/1996 Kobayashi et al.
5,679,065 A 10/1997 Henderson
6,027,398 A * 2/2000 Numoto et al. ..... 451/285
6,110,025 A * 8/2000 Williams et al. ..... 451/286
6,113,468 A * 9/2000 Natalicio ..... 451/41
6,116,992 A * 9/2000 Prince ..... 451/286
6,419,567 B1 * 7/2002 Glashauser ..... 451/259

FOREIGN PATENT DOCUMENTS

GB 2 307 342 5/1997
GB 2 347 790 9/2000

* cited by examiner

*Primary Examiner*—Dung Van Nguyen
(74) *Attorney, Agent, or Firm*—Nixon Peabody LLP; David S. Safran

(57) ABSTRACT

A step part is formed on a face of a retainer ring that contacts with a polishing pad so that a wavily deformed part of the polishing pad enters the step part. The step part is formed like a ring at the inside of the face which actually contacts with the polishing pad. Moreover, a height of the step part is smaller than a thickness of a wafer so that a top face of the step part does not contact with the polishing pad and the wafer does not enter the step part. Further, a width of the step part is set so that the wavily deformed part of the polishing pad can enter the step part.

3 Claims, 5 Drawing Sheets

WAFER POLISHING APPARATUS

BACKGROUND OF THE INVENTION

1. Field of the Invention

The present invention relates to a wafer polishing apparatus which polishes a wafer in the chemical mechanical polishing (CMP) method.

2. Description of the Related Art

U.S. Pat. No. 5,584,751 discloses a wafer polishing apparatus which mainly comprises, as seen from FIG. 5, a wafer holding head 3 having a carrier 1 and a retainer ring 2, and a platen 5 to which a polishing pad 4 is adhered. The wafer polishing apparatus polishes a wafer 6 by pressing the wafer 6 with the carrier 1 against the polishing pad 4 which is rotating, and at the same time presses the retainer ring 2 arranged at an outer periphery of the carrier 1 against the polishing pad 4 so as to surround the periphery of the wafer 6, thereby preventing the wafer 6 from slipping out of the carrier 1.

The material of the polishing pad 4 is selected either a hard type or soft type depending on the material (such as $SiO_2$) of the polished layer (insulator film) of the wafer. When the polishing pad 4 of the soft type is used, a part along the periphery of the polishing pad 4 which contacts with the retainer ring 2 is waved (so-called waving occurs on the polishing pad 4). If the waving occurs on the polishing pad 4, an outer periphery 6A of the wafer 6 is excessively polished by a wavily deformed part 4C of the polishing pad 4, and the wafer 6 is not uniformly polished.

The waving occurs specifically in parts 4A and 4B which contact with an outer periphery 2A and an inner periphery 2B of the retainer ring 2 positioned at an upstream in a rotation direction of the polishing pad 4, and also in a part 4C which contacts with an inner periphery 2C of the retainer ring 2 positioned at a downstream in the rotation direction of the polishing pad 4. Although the parts 4A and 4B do not cause problems since they are away from the outer periphery 6A of the wafer 6, the part 4C at the inner periphery 2C is excessively polished because the outer periphery 6A of the wafer 6 contacts with the wavily deformed part 4C.

In order to cope with the problem, the wafer polishing apparatus of U.S. Pat. No. 5,584,751 prevents the waving and the excessive polishing of the outer periphery 6A of the wafer 6 by lowering a pushing force of the retainer ring 2 against the polishing pad 4.

However, the wafer polishing apparatus cannot perfectly eliminate the waving.

The polishing pad surrounded by the retainer ring keeps its flatness by being pressed by the retainer ring and elastically deformed. Thus, the contact force of the retainer ring is set to be the same as a restoring force of the polishing pad. If the contact force of the retainer ring is lowered as described above, the restoring force of the polishing pad becomes larger than the pushing force of the retainer ring. The polishing pad is thus wavily deformed along the outer periphery of the wafer, and the outer periphery of the wafer is excessively polished.

SUMMARY OF THE INVENTION

The present invention has been developed in view of the above-described circumstances, and has as its object the provision of a wafer polishing apparatus which can uniformly polish the entire surface of the wafer by preventing the excessive polishing of an outer periphery of the wafer.

In order to achieve the above-described object, the present invention is directed to a wafer polishing apparatus which polishes a surface of a wafer, comprising: a carrier that holds the wafer and presses the surface of the wafer against a polishing pad that is rotating; and a retainer ring which is arranged at an outer periphery of the carrier to surround the periphery of the wafer and is pushed against the polishing pad, the retainer ring having a step part on a face that contacts with the polishing pad so that a wavily deformed part of the polishing pad enters the step part.

In order to achieve the above-described object, the present invention is directed to a wafer polishing apparatus which polishes a surface of a wafer, comprising: a carrier that holds the wafer; a first pressing device that presses the carrier against a polishing pad that is rotating; a pressurized air layer forming device that forms a pressurized air layer between the carrier and the wafer and transmits a pressing force from the first pressing device to the wafer through the pressurized air layer; a retainer ring which is arranged at an outer periphery of the carrier to surround the periphery of the wafer and is pushed against the polishing pad, the retainer ring having a step part on a face that contacts with the polishing pad so that a wavily deformed part of the polishing pad enters the step part; and a second pressing device that presses the retainer ring against the polishing pad.

The invention relates to a wafer polishing apparatus which presses the wafer against the polishing pad with the carrier to polish the wafer. The invention relates to a wafer polishing apparatus which presses the wafer against the polishing pad with the carrier to polish the wafer by forming the pressurized air layer between the carrier and the wafer and transmitting the pressing force to the wafer through the pressurized air layer. The present invention provides a step part to the retainer ring of the wafer polishing apparatus so that the wavily deformed part of the polishing pad enters the step part.

By the above-described structure, the wavily deformed part caused by the waving of the polishing pad occurs away from the outer periphery of the wafer. Therefore, the present invention prevents the excessive polishing of the outer periphery of the wafer without suppressing occurrence of the waving, and thus can uniformly polish the entire surface of the wafer.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereunder a preferred embodiment of the present invention will be described in detail in accordance with the accompanying drawings.

Figure 1:
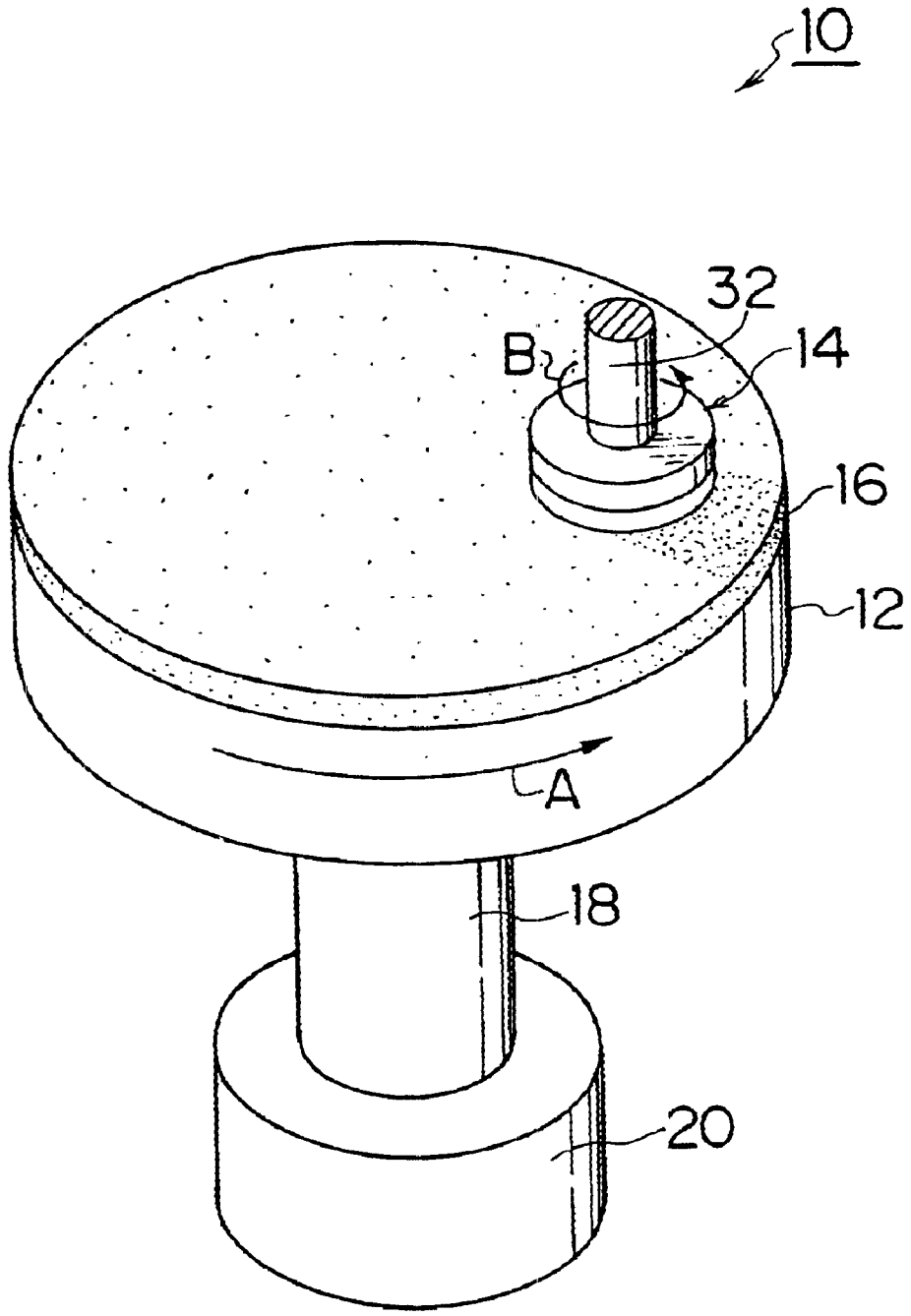
FIG. 1 is a view of an entire structure of a wafer polishing apparatus for an embodiment of the present invention.

FIG. 1 is a view of an entire structure of a wafer polishing apparatus 10 for the embodiment of the present invention which comprises mainly a platen 12 and a wafer holding head 14, the platen being formed like a disk, and a polishing pad 16 is adhered to the top face of the platen 12. Material for the polishing pad 16 is suede, non-woven cloth, foam urethane, and so forth, and material is selected to suite the material of a polished layer of the wafer, and is adhered to the platen 12.

The bottom of the platen 12 is connected with a spindle 18 which is connected with an output shaft (not shown) of a motor 20. The platen 12 rotates in a direction of an arrow A by driving the motor 20, and mechano-chemical polishing agent (i.e. slurry) is supplied from a nozzle (not shown). Mechano-chemical polishing agent is used in which $BaCO_3$ particles are suspended in KOH solution if the polished layer is made of silicon.

The wafer holding head 14 is provided to move vertically by an elevator (not shown), and moves up and down when setting a wafer to be polished to the wafer holding head 14. The wafer holding head 14 also moves down when polishing the wafer so as to be pressed with the wafer against the polishing pad 16. In FIG. 1, the wafer holding head 14 is one; but the number of the wafer holding head 14 is not limited to one. For example, in view of manufacturing efficiency, providing plural wafer holding heads is preferable on a circumference about the spindle 18.

Figure 2:
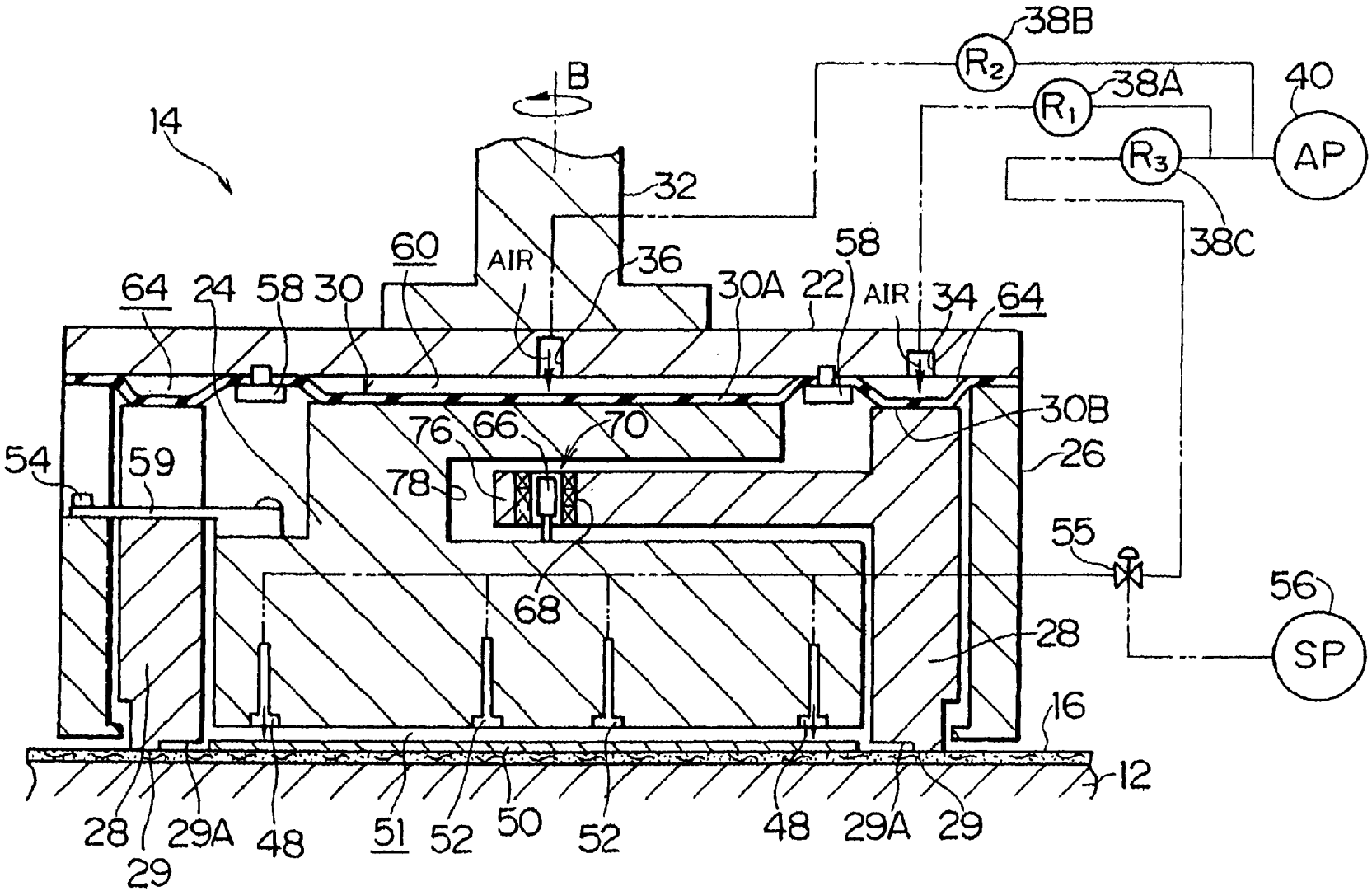
FIG. 2 is a vertical section view of a wafer holding head which is applied to the polishing apparatus in FIG. 1.

FIG. 2 is a vertical section view of the wafer holding head 14, which comprises a head 22, a carrier 24, a guide ring 26, a retainer ring 28, a rubber sheet 30, and so forth. The head 22 is formed like a disk, and rotates in a direction of an arrow B in FIG. 2 by a motor (not shown) which is connected with a rotation shaft 32. Moreover, air supply passages 34 and 36 are formed at the head 22. The air passage 34 is extended to outside of the wafer holding head 14 as depicted with an alternate long and two short dashes line in FIG. 2, and is connected with an air pump (AP) 40 via a regulator (R) 38A. The air passage 36 is connected with the air pump 40 via a regulator 38B.

The carrier 24 is cylindrically formed and is arranged at the bottom of the head 22 so as to be coaxial with the head 22. The carrier 24 is also fixed to the guide ring 26 by a pin 54 via three (only one is shown in FIG. 2) connecting members 59 which are fixed to the carrier 24.

The carrier 24 has many air supply passages 48, 48, . . . (only two of them are shown in FIG. 2) which jetting openings are formed at the outer periphery of the bottom face of the carrier 24, and also has many air supply passages 52, 52, . . . (only two of them are shown in FIG. 2) which jetting openings are formed at the inner periphery of the bottom face thereof. As seen from the alternate long and two short dashes line in FIG. 2, the air supply passages 48 and 52 are extended to outside of the holding head 14, and one of the groups of the air supply passages 48 and 52 is connected with a suction pump (SP) 56 via a switch valve 55 and the other group of the air supply passages 48 and 52 is connected with the air pump 40 via a regulator 38C. According to the structure, when a group of the air supply passages at the air pump 40 side is closed while the other group of the air supply passages at the suction pump 56 side is opened by the switch valve 55, a wafer 50 is adhered and held to the bottom face of the carrier 24 by a suction force of the suction pump 56. When a group of the air supply passages at the air pump 40 side is opened while the other group of the air supply passages at the suction pump 56 side is closed by the switch valve 55, the compressed air is jetted from the air pump 40 into an air chamber 51 between the carrier 24 and the wafer 50 via the air supply passages 48 and 52. Therefore, the pressurized air layer is formed in the air chamber 51, and the pressing force of the carrier 24 is transmitted to the wafer 50 via the pressurized air layer.

The wafer holding head 24 as described above moves the carrier 24 up and down by regulating the pressing force applied to the carrier 24 whereby it controls a polishing pressure of the wafer 50 (i.e. a force for pressing the wafer 50 against the polishing pad 16); thus a polishing pressure can be more easily controlled than in a case for controlling the polishing pressure of the wafer 50 by regulating the pressure of the pressurized air layer. In short, when using the wafer holding head 14, the polishing pressure of the wafer 50 can be controlled only by regulating vertical positions of the carrier 24. In addition, the air which is jetted from the air supply passages 48 are exhausted to outside from exhaust holes (not shown) which are formed at the retainer ring 28.

One sheet 30 made of rubber (hereunder called a rubber sheet) is arranged between the carrier 24 and head 22. The rubber sheet 30 is formed like a disk with a uniform thickness, and is fixed at the bottom face of the head 22 by a ring-shaped stopper 58, whereby the rubber sheet 30 is divided in two which are a central part 30A and an outer periphery 30B by a stopper ring 58 as a boundary. The central part 30A serves as an airbag for pressing the carrier 24 while the outer periphery 301B serves as an airbag for pressing the retainer ring 28.

A space 60 is formed at the bottom portion of the head 22 which is closed airtight by the central part 30 and the stopper 58 of the rubber sheet 30, and through which the air supply passage 36 is connected. According to the structure, when the compressed air is supplied from the air supply passage 36 into the space 60, the central part 30A of the rubber sheet 30 is elastically deformed by the air pressure so as to press the top face of the carrier 24, whereby a pressing force of the wafer 50 with respect to the polishing pad 16 can be achieved. Moreover, the pressing force (i.e. the polishing pressure) of the wafer 50 can be controlled by adjusting the air pressure with the regulator 38B.

The cylindrical guide ring 26 is arranged at the bottom part of the head 22 so as to be coaxial with the head 22, and is also fixed to the head 22 via the rubber sheet 30. The retainer ring 28 is arranged between the guide ring 26 and the carrier 24.

The retainer ring 28 is arranged at the outer periphery of the carrier 24 and surrounds the wafer 50; hence, the retainer ring 28 has a function to prevent the wafer 50 being polished from slipping out of the carrier. The outer peripheral edge of the wafer 50 being polished comes into contact with the inner peripheral face of the retainer ring 28 at the downstream of the rotation direction by rotation of the polishing pad 16. The rotation force of the retainer ring 28 is transmitted to the wafer 50 with its outer peripheral edge contacting, and thus the wafer 50 is also rotated by a predetermined number of rotation. An inner peripheral face of the retainer ring 28 with which the outer peripheral edge of the wafer 50 contacts is made of soft material such as resin that does not damage the contacting wafer 50.

An annular space 64 is formed at the bottom outer peripheral part of the head 22 which is closed airtight by the head 22 and the outer periphery 30B of the rubber sheet and the like. The space 64 has the air supply passage 34 which goes through the space 64. According to the structure, when the compressed air is supplied from the air supply passage 34 into the space 64, the outer periphery 30B of the rubber sheet 30 is elastically deformed by the air pressure and presses the annular top face of the retainer ring 28, whereby an annular bottom face (contact face) 29 of the retainer ring 28 is pressed against the polishing pad 16. The pressing force of the retainer ring 28 can be controlled by adjusting the air pressure by the regulator 38A. Moreover, the contact face 29 of the retainer ring 28 is coated with diamond in order to improve resistance to friction against the polishing pad 16.

A detector for detecting a polished amount of the wafer 50 is provided to the wafer holding head 14. The detector is a sensor 70 comprising a core 66 and a bobbin 68, and a CPU (shown in FIG. 3) for calculating and processing a detected value detected by the sensor 70 is provided at outside the wafer holding head 14

In FIG. 2, a sensor 70 is a differential transformer. The bobbin 68 which constitutes the differential transformer is attached to the top end of an arm 76, that is extended from the inner face of the retainer ring 28 in a direction of a rotation shaft of the wafer holding head 14. The core 66 of the sensor 70 is arranged at a position where its central shaft is coaxial with the counterpart of the wafer holding head 14. The sensor 70 can detect a moving amount of the carrier 24 with respect to the contact face 29 of the retainer ring 28, and can also detect a collapsing position of the retainer ring 28 with respect to the surface of the polishing pad 16. The carrier 24 has a groove 78 which is formed for the arm 76 to be inserted therein.

A step part 29A is formed on the contact face 29 so that a wavily deformed part of the polishing pad 16 enters the step part 29A.

Figure 4:
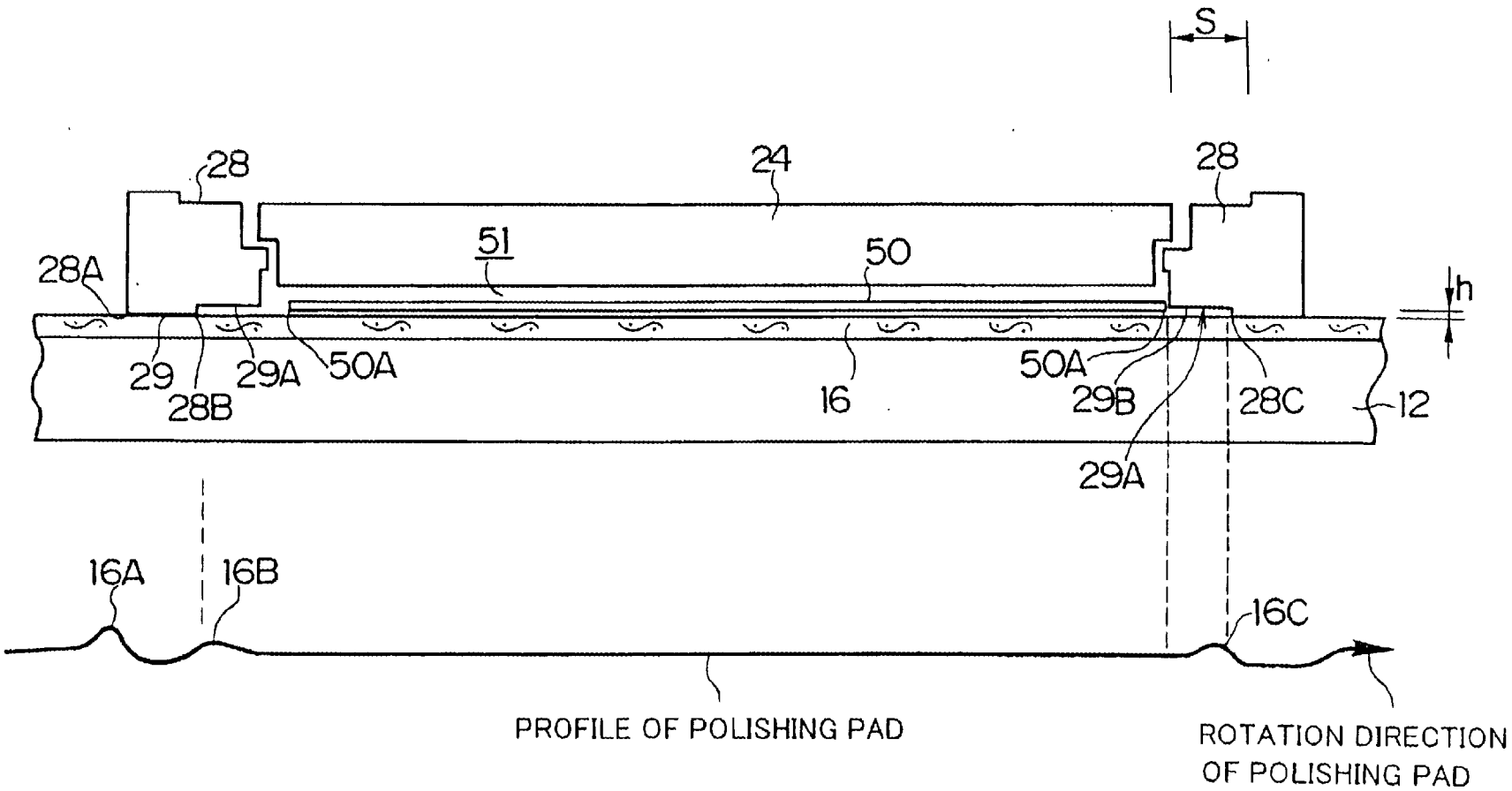
FIG. 4 is a model view for illustrating a profile of the polishing pad during polishing of the wafer.
Figure 5:
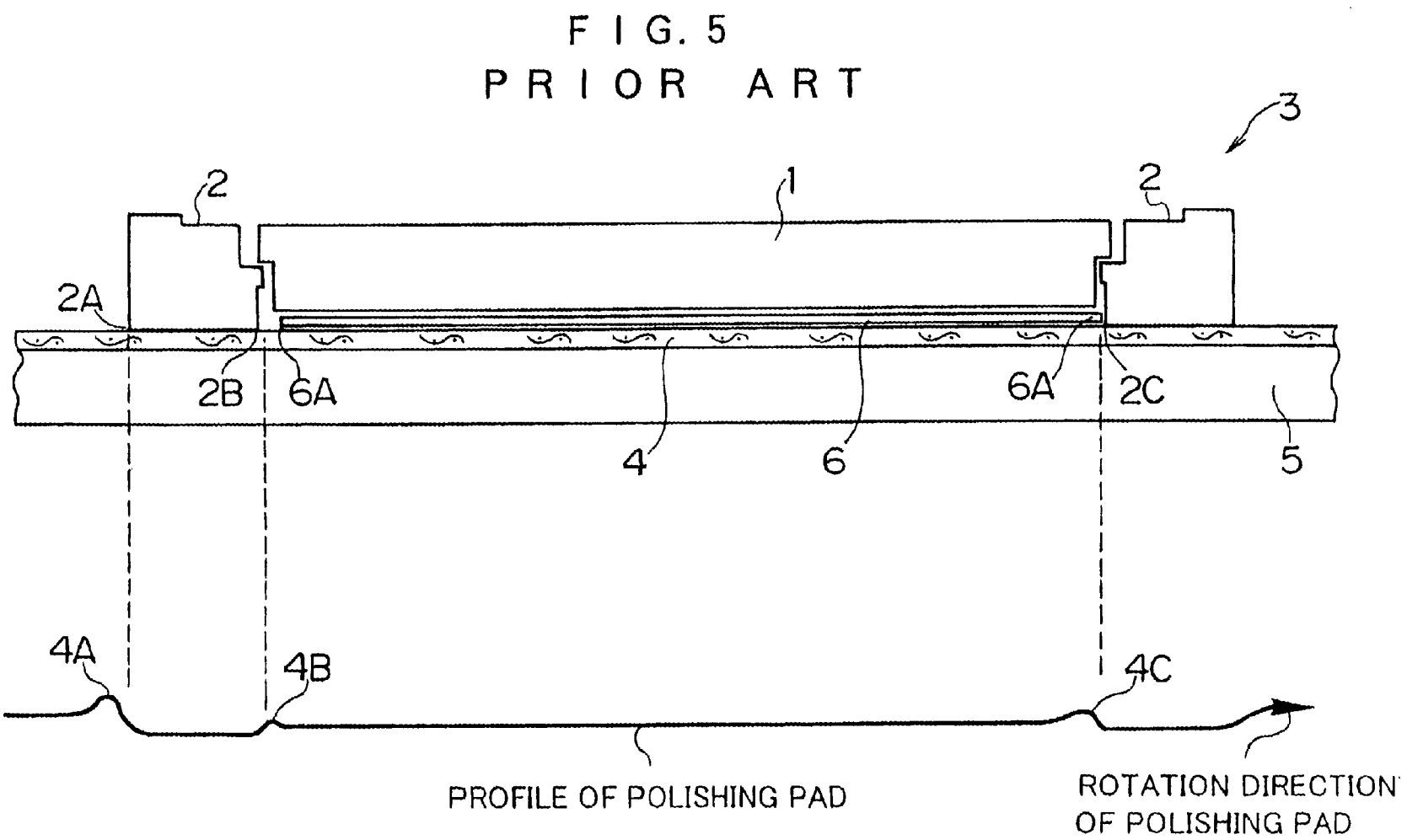
FIG. 5 PRIOR ART
FIG. 5 is another model view for illustrating a profile of the polishing pad during polishing of the wafer in a conventional method.

As shown in FIG. 4, the step part 29A is formed in an annual shape at inside of the contact face 29 which actually comes into contact with the polishing pad 16. A height h of the step part 29A is smaller than a thickness of the wafer 50 so that a top face 29B of the step part 29A does not contact with the polishing pad 16 and the wafer 50 does not enter the step part 29A. Moreover, a width S of the step part 29A is set such that a wavily deformed part 16C caused by an inner periphery 28C at the downstream in the rotation direction of the polishing pad 16 can enter the step part 29A. Thereby, the wavily deformed part 16C occurs away from the outer peripheral edge 50A of the wafer 50. Waving also occurs at parts 16A and 16B which contact with an outer peripheral edge 28A and an inner peripheral edge 28B of the retainer ring 28 at the upstream of the rotation direction of the polishing pad 16; however, the wavily deformed parts 16A and 16B do not affect a uniform polishing of the wafer 50 since they are away from the outer periphery 50A of the wafer 50.

Now, an operation will be described of the wafer polishing apparatus 10 which is constructed as described above.

First, the wafer holding head 14 is moved up and the suction pump 56 is activated, so the wafer 50 to be polished is adhered and held to the bottom face of the carrier 24.

Second, the wafer holding head 14 is moved down and then is stopped from moving down at a position where the contact face 29 of the retainer ring 28 of the wafer holding head 14 comes into contact with the polishing pad 16. Then, the group of the air passages at the suction pump 56 side is closed by the switch valve 55 so as to release the holding of the wafer 50, and the wafer 50 is placed on the polishing pad 16.

Third, the air pump 40 is activated so as to supply the compressed air into the air chamber 51 via the air supply passages 48, and the pressurized air layer is formed in the air chamber 51.

Fourth, the compressed air from the air pump 40 is supplied into the space 60 via the air supply passages 36, and the central part 30A of the rubber sheet 30 is elastically deformed so as to press the carrier 24 then as to press the wafer 50 against the polishing pad 16 through the pressurized air layer. After that, the air pressure is adjusted by the regulator 38B and the inner air pressure is regulated at a desired pressure, then the pressing force (i.e. polishing pressure) of the wafer 50 against the polishing pad 16 is kept constant.

Fifth, the compressed air from the air pump 40 is supplied into the space 64 via the air supply passages 34, and the outer periphery 30B of the rubber sheet 30 is elastically deformed so as to press the retainer ring 28, then the contact face 29 of the retainer ring 28 is pressed against the polishing pad 16.

Sixth, the air pressure is adjusted by the regulator 38A so that the air pressure is adjusted at an air pressure stored by a RAM 75 of a CPU 74, and the air pressure is kept constant by the regulator 38A again after adjusting the collapsing position of the retainer ring 28.

Figure 3:
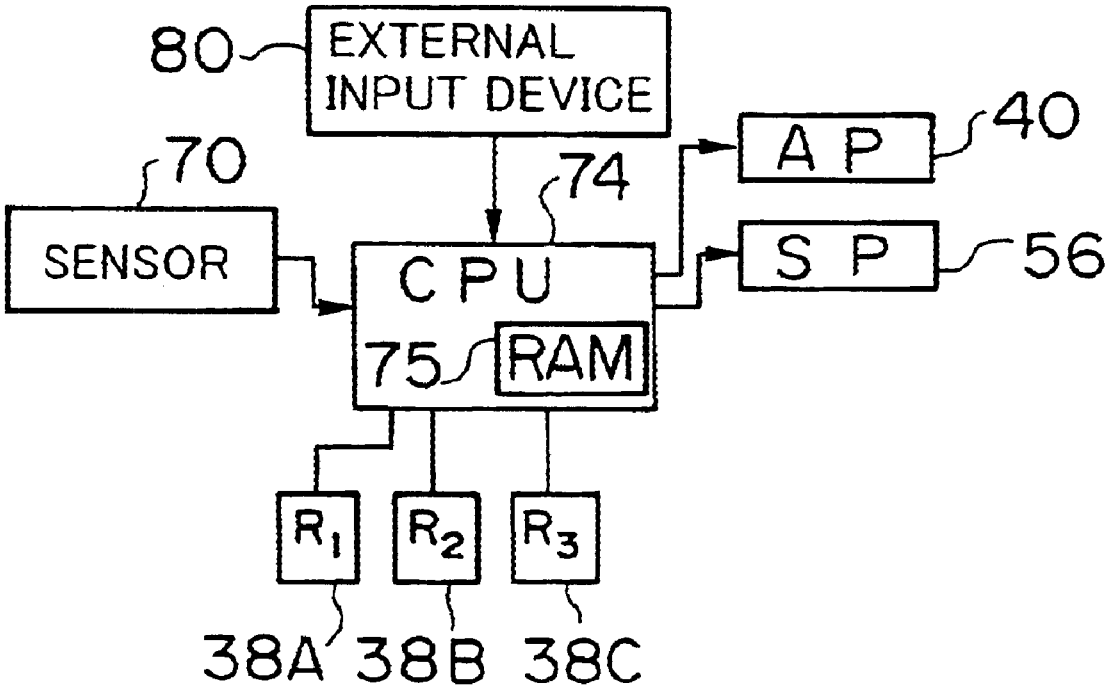
FIG. 3 is a block diagram showing a control system of the wafer polishing apparatus in FIG. 1.

Seventh, the polishing pressure is set by an external input device 80 shown in FIG. 3; after that, the platen 12 and the wafer holding head 14 are rotated and polishing of the wafer 50 is started. The polishing pressure set by the external input device may be set beforehand rather than just before polishing.

Finally, the polishing amount of the wafer 50 during polishing is calculated by the sensor 70 and the CPU 74. When the calculated polishing amount of the wafer 50 reaches at a polishing target value which is set beforehand, a signal for stopping polishing is outputted, and the wafer polishing apparatus 10 stops polishing. Polishing of one wafer 50 is completed by the above-described process, and the process can go over repeatedly when polishing the second wafer 50 afterwards.

During polishing of the wafer 50, the wavily deformed part 16C caused by the waving on the polishing pad 16 occurs at a section which is away from the outer peripheral edge 50A of the wafer 50 as seen from FIG. 4 because the wafer holding head 14 of the present embodiment has the step part 29A which is formed for flattening the wavily deformed part 16C of the polishing pad 16. Therefore, the wafer polishing apparatus 10 of the present invention can prevent the excessive polishing of the outer peripheral edge of the wafer without suppressing the waving, and the entire surface of the wafer can thus be uniformly polished.

In the present embodiment, the wafer polishing apparatus 10 is described which polishes the wafer 50 through the pressurized air layer. However, the wafer polishing apparatus is not limited to that type; the retainer ring 28 can also be applied to the wafer polishing apparatus which directly holds the wafer with the carrier and polishes the wafer by pressing the wafer against the polishing pad.

As described above, the wafer polishing apparatus of the present invention has a step part on the retainer ring so that the wavily deformed part of the polishing pad enters the step part. Therefore, the excessive polishing of the outer periphery of the wafer can be prevented without suppressing the waving, and hence the entire surface of the wafer can be uniformly polished.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus which polishes a surface of a wafer, comprising:

a carrier that holds the wafer and presses the surface of the wafer against a polishing pad that is rotating; and a retainer ring which is arranged at an outer periphery of the carrier to surround the periphery of the wafer and is pushed against the polishing pad, the retainer ring having an inner peripheral wall within which the wafer is confined by said peripheral wall and a recess part extending outward from said inner peripheral wall on an inner edge of a level face that contacts with the polishing pad so that a wavily deformed part of the polishing pad enters the recess part.

2. A wafer polishing apparatus which polishes a surface of a wafer, comprising:

a carrier that holds the wafer;

a first pressing device that presses the carrier against a polishing pad that is rotating;

a pressurized air layer forming device that forms a pressurized air layer between the carrier and the wafer and transmits a pressing force from the first pressing device to the wafer through the pressurized air layer;

a retainer ring which is arranged at an outer periphery of the carrier to surround the periphery of the wafer and is pushed against the polishing pad, the retainer ring having a step part on a face, the step part having an inner peripheral wall within which the wafer is confined by said peripheral wall, that extends outward from said inner peripheral wall and that contacts with the polishing pad so that a wavily deformed part of the polishing pad enters the step part; and a second pressing device that presses the retainer ring against the polishing pad.

3. A wafer polishing apparatus which polishes a surface of a wafer, comprising:

a carrier that holds the wafer;

a first pressing device that presses the carrier against a polishing pad that is rotating;

a pressurized air layer forming device that forms a pressurized air layer between the carrier and the wafer and transmits a pressing force from the first pressing device to the wafer through the pressurized air layer;

a retainer ring which is arranged at an outer periphery of the carrier to surround the periphery of the wafer and is pushed against the polishing pad, the retainer ring having an inner peripheral wall within which the wafer is confined by said peripheral wall and a recess part extending outward from said inner peripheral wall on an inner edge of a level face that contacts with the polishing pad so that a wavily deformed part of the polishing pad enters the recess part; and a second pressing device that presses the retainer ring against the polishing pad.

* * * * *